US011492165B2

(12) United States Patent
Drocco et al.

(10) Patent No.: US 11,492,165 B2
(45) Date of Patent: Nov. 8, 2022

(54) WORKING LINE FOR FLUIDIC PRODUCTS CONTAINED IN PRE-DOSED CONTAINERS

(71) Applicant: DROMONT S.P.A., Grinzane Cavour (IT)

(72) Inventors: Luca Drocco, Alba (IT); Mario Drocco, Alba (IT)

(73) Assignee: DROMONT S.P.A., Grinzane Cavour (IT)

( * ) Notice: Subject to any disclaimer, the term of this patent is extended or adjusted under 35 U.S.C. 154(b) by 80 days.

(21) Appl. No.: 16/968,139

(22) PCT Filed: Feb. 5, 2019

(86) PCT No.: PCT/IB2019/050892
§ 371 (c)(1),
(2) Date: Aug. 6, 2020

(87) PCT Pub. No.: WO2019/155353
PCT Pub. Date: Aug. 15, 2019

(65) Prior Publication Data

US 2021/0371147 A1 Dec. 2, 2021

(30) Foreign Application Priority Data

Feb. 7, 2018 (IT) ..... 102018000002455

(51) Int. Cl.
*B65B 7/28* (2006.01)
*B65B 43/40* (2006.01)
(Continued)

(52) U.S. Cl.
CPC ..... *B65B 65/003* (2013.01); *B65B 7/28* (2013.01); *B65B 43/52* (2013.01); *B65B 2220/14* (2013.01)

(58) Field of Classification Search
CPC ..... B65B 7/28; B65B 43/40
(Continued)

(56) References Cited

U.S. PATENT DOCUMENTS 3,380,225 A 4/1968 Ochs et al.
3,438,174 A 4/1969 Foss et al.
(Continued)

FOREIGN PATENT DOCUMENTS

DE 3507294 A1 * 9/1985 ..... B65B 69/00
DE 3507294 A1 9/1985
WO 2010/140048 A2 12/2010

OTHER PUBLICATIONS

International Search Report and Written Opinion from International Application No. PCT/IB2019/050892, dated Apr. 5, 2019.

*Primary Examiner* — Thanh K Truong
*Assistant Examiner* — Patrick B Fry
(74) *Attorney, Agent, or Firm* — Merchant & Gould P.C.

(57) ABSTRACT

A working line is for fluidic or fluid products contained in pre-dosed containers. The container includes a cover and/or lid for closing the container. The working line includes a first manipulation station having a manipulator to manipulate the cover and/or lid to remove the cover and/or lid from the container to open the container. A working station carries out at least one operation on the fluid product contained in the container after the removal of the cover and/or lid from the container. A second manipulation station includes a manipulator to manipulate the cover and/or lid to associate the cover and/or lid with the container to close the container. A transportation system moves the pre-dosed containers among different stations. The working station is located between the first manipulation station and the second manipulation station. The manipulator manipulates covers and/or lids associable with the container through joint-type and/or screw-type devices.

6 Claims, 6 Drawing Sheets

(51) Int. Cl.
*B65B 43/52* (2006.01)
*B65B 65/00* (2006.01)

(58) Field of Classification Search
USPC ..... 53/266.1, 281, 381.4, 471, 492
See application file for complete search history.

(56) References Cited

U.S. PATENT DOCUMENTS

| | | | | |
|---|---|---|---|---|
| 4,979,350 | A | 12/1990 | Arnemann | |
| 5,305,581 | A * | 4/1994 | Reeves, Jr. | B65B 7/2842 53/281 |
| 6,256,964 | B1 * | 7/2001 | Drevfors | B65B 55/025 53/109 |
| 7,753,085 | B2 * | 7/2010 | Tribble | A61J 1/20 141/2 |
| 7,836,669 | B1 * | 11/2010 | Cassil | B67B 3/2033 53/490 |
| 7,845,149 | B2 * | 12/2010 | Owen | G01N 35/026 53/490 |
| 2007/0006550 | A1 | 1/2007 | Kemper et al. | |
| 2011/0010255 | A1 * | 1/2011 | Drocco | B01F 13/1072 705/17 |
| 2012/0110952 | A1 | 5/2012 | Zardini | |

* cited by examiner

WORKING LINE FOR FLUIDIC PRODUCTS CONTAINED IN PRE-DOSED CONTAINERS

This application is a National Stage Application of International Application No. PCT/IB2019/050892, filed 5 Feb. 2019, which claims benefit of Serial No. 102018000002455, filed 7 Feb. 2018 in Italy and which applications are incorporated herein by reference. To the extent appropriate, a claim of priority is made to each of the above disclosed applications.

TECHNICAL FIELD

The present invention relates to a working line for fluidic or fluid products contained in containers. Said line is adapted to carry out operations on pre-dosed containers, the contents of which need to be worked to give the desired final product. Therefore, within the containers there is a semi-finished product, in particular a material base, e.g. paint, which will be subjected to at least one operation along said working line.

SUMMARY OF THE INVENTION

The line according to the present invention can automatically process pre-dosed containers, thus reducing the risk of contamination and/or dripping of the fluid products.

The working line comprises at least two manipulation stations for manipulating the covers and/or lids comprised in the containers. Such manipulation stations can remove and/or re-position a cover and/or a lid associated with a container.

Containers are known, in particular for containing fluids such as, for example, paints, which are fitted with a closed cover, e.g. a pressure-type cover, with a screwed-on lid. The system according to the present invention is particularly suitable for manipulating such types of covers and/or lids.

Working lines are known wherein containers are fed manually into the line, and lids and/or covers are removed manually from the incoming containers in order to be able to carry out subsequent operations, particularly the dosing of additional fluid and/or powder products, so as to obtain the desired product.

The step of removing the lid and/or cover, which is carried out manually, implies the risk that part of the fluid product might drip, thus soiling parts of the line and/or of the container itself. The dripped part of the fluid product needs to be removed from the container and/or from the line before the container moves on along the line. The operator must necessarily use suitable cloths, e.g. paper rags, and/or solvents in order to remove such fluid product, resulting in increased costs in terms of required and wasted material, which will then have to be appropriately treated and disposed of.

It is also known that, for particular types of containers having a pressure-type cover made of metallic material, manual removal of such a cover may cause damage to the structure of the container and/or of the cover, leading to container sealing problems. Moreover, the damaged container and/or cover may cause, in addition to an undesired aesthetic effect, problems when stacking the containers at the end of the process.

Containers are also known which have a lid screwed on a pressure-fit cover that cannot be easily manipulated. In current lines, this type of lid is removed manually and is definitively separated from the container, with which a new lid will then be associated at the end of the process. This solution implies an additional production cost, since it is necessary to substitute the lids, while also posing the problem of cleaning and/or disposing of the removed lids.

It is known from the patent application WO2010140048A2 a machine and method for treating containers of liquids comprising at least a loading station, into which baskets containing the containers to be subjected to the treatment are loaded, each of which containers is associated with a relative lid, and a washing station, in which the containers are subjected at least to washing. The machine comprises, integrated with it, a treatment device that effects the treatment of dirty lids which is operatively parallel with at least the washing station to provide automatically at exit the treated lids in order to close the washed containers.

It is also known from the patent application US2012110952A1 a machine and method for treating containers of liquids comprising a loading station into which baskets are loaded containing, according to a desired pattern of disposition, the containers to be subjected to washing, a filling station in which the washed containers are filled with new liquid, and a re-closing station in which the containers are closed by the relative lids. The re-closing station comprises a closing device provided with gripper members by means of which the lids are picked up and positioned so as to close the containers, and loading members that automatically direct the lids toward the closing device in a manner consistent with the desired pattern of disposition of the containers in the baskets. The closing device comprises movement members that move the gripper members automatically between a pick-up position in correspondence with the loading members and a position of closure in correspondence with the containers. The loading members comprise stop elements, able to be selectively activated to automatically dispose the lids in a manner consistent with the predetermined pattern of disposition of the containers.

It is known from the patent application DE3507294A1 an automatic lid-removing and lid-fastening arrangement for a container which can be used repeatedly for transporting liquids or powdery materials, in which arrangement a lid is removed from a conveyed container filled with a content and provided with a lid and the lid thus removed is, after being cleaned, fastened to a container of which the content has been emptied. This arrangement has a lid-removing device for covering the container filled with a content, an emptying device for emptying the covered container and a lid-fastening device for fastening a cleaned lid to the cleaned empty container, the lid-removing device transporting the retained lid to a cleaning station and subsequently to a storage device which stores a plurality of lids in the form of a stack. The particular uppermost lid of the lid stack is extracted as required.

Are also known different devices and machines able to apply and/or remove a threaded caps, as disclosed in the following patent literatures U.S. Pat. Nos. 3,438,174A, 3,380,225A, US 2007006550A1 and U.S. Pat. No. 4,979,350A.

The present invention aims at solving these and other technical problems by providing a working line that comprises at least two manipulation stations for manipulating the cover and/or lid, between which working stations are located for working the fluid contained in the containers subject to manipulation of their covers and/or lids.

One aspect of the present invention relates to a working line for fluid products pre-dosed in containers having at least one removable cover and/or lid.

A further aspect of the present invention relates to a method for manipulating the container.

BRIEF DESCRIPTION OF THE DRAWINGS

The features and advantages of the working line and method will become apparent in the light of the following description of several possible embodiments thereof and of the annexed drawings, wherein:

FIG. 4A shows the conveyance system, applicable to a manipulation station for removing covers and/or lids, in a first operating configuration; FIG. 4B shows a magnification of the conveyance system of FIG. 4A; FIG. 4C shows the conveyance system, applicable to a manipulation station for removing covers and/or lids, in a second operating configuration; FIG. 4D shows the conveyance system, applicable to a manipulation station for fixing the covers and/or lids, in a first operating configuration; FIG. 4E shows a magnification of the conveyance system in a second operating configuration;

FIG. 5A shows the manipulator in an identification operating configuration; FIG. 5B shows the manipulator in an alignment operating configuration;

FIG. 6A shows the manipulator engaging the lid that will have to be removed; FIG. 6B shows the manipulator unscrewing the lid from the container; FIG. 6C shows the manipulator after it has separated the lid from the container;

FIG. 7A shows the manipulator engaging the cover that will have to be removed; FIG. 7B shows the manipulator acting upon the cover of the container in order to allow the separation thereof; FIG. 7C shows the manipulator after it has separated the cover from the container.

DETAILED DESCRIPTION OF THE INVENTION

Figure 1:
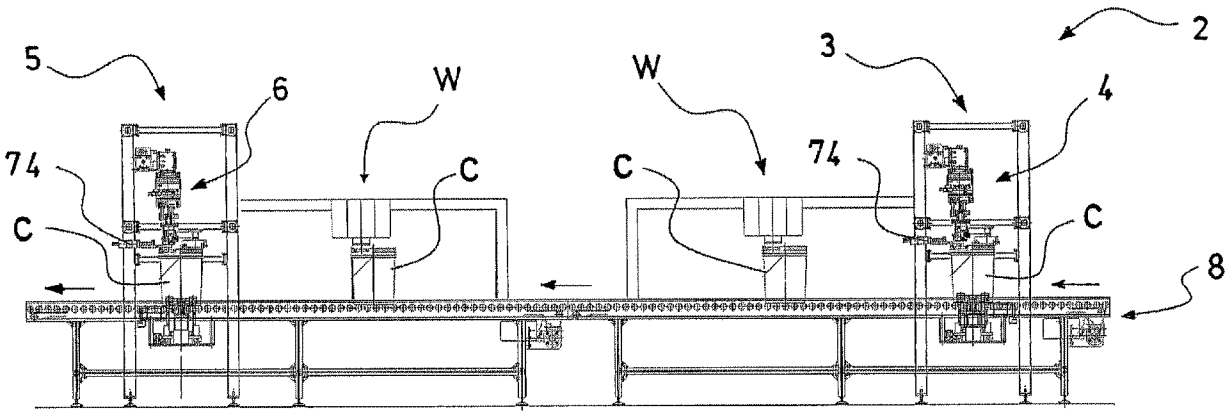
FIG. 1 shows a front view of one possible exemplary, but non-limiting, embodiment of a working line for fluid products contained in pre-dosed containers.

With reference to the above-listed figures, reference numeral 2 designates as a whole the working line according to the present invention.

Working line 2 according to the present invention is particularly adapted for processing fluid products contained in containers "C" pre-dosed with such fluid products.

Said container "C", adapted to be fed into working line 2, in turn comprises at least one cover and/or one lid "L" for closing container "C".

For the purposes of the present invention, the term fluid products refers to products such as paints, dyes and/or lacquers or bases for making surface-covering products.

For the purposes of the present invention, the term pre-dosed container refers to a container containing a quantity of fluids; therefore, it is not an empty container.

For the purposes of the present invention, the term cover and/or lid refers to a closing system capable of preventing the fluid product contained in the container from accidentally leaking out, when said cover and/or lid is coupled, in particular tightened, onto an opening comprised in at least a portion of the container and/or cover. Said opening may be an opening in the container itself or an opening formed on a closing system of the cover, e.g. a larger cover.

Working line 2 according to the present invention comprises: a first manipulation station 3; the latter comprises in turn at least one manipulator 4. Said manipulator 4 is adapted to manipulate said cover and/or lid "L", so as to remove said cover and/or lid "L" from said container "C". The manipulation effected on cover and/or lid "L" by manipulator 4 can open said container "C", in particular by decoupling, and in particular by removing, said cover and/or lid "L" from the opening with which they are associated. In particular, said manipulator 4 can remove cover and/or lid "L" without damaging either the container or the cover and/or lid.

Working line 2 according to the present invention comprises at least one working station "W". Said working station "W" is adapted to carry out at least one operation on the fluid product contained in container "C". In particular, said working station "W" is adapted to carry out such operation after said cover and/or lid "L" has been removed from container "C".

For the purposes of the present description, the phrase operation on a fluid product refers to the execution of an operation that can modify, at least partly, at least one characteristic of the fluid product contained in container "C". One possible operation may be the addition of another product, whether fluid and/or solid and/or in granular or powder form, or a mixing and/or stirring step, or the taking of a sample, e.g. for checking the quality of the fluid product.

Working line 2 according to the present invention comprises also a second manipulation station 5. Said manipulation station 5 in turn comprises at least one manipulator 6. Said manipulator 6 is adapted to manipulate said cover and/or lid "L" so as to associate said cover and/or lid "L" with said container "C".

The manipulation effected on cover and/or lid "L" by manipulator 6 can close said container "C", in particular by coupling, preferably tightening, said cover and/or lid "L" to the opening with which they have to be associated. In particular, said manipulator 6 can secure cover and/or lid "L" without damaging either container "C" or cover and/or lid "L".

Working line 2 according to the present invention further comprises a transportation system 8. Said transportation system 8 is adapted to move pre-dosed containers "C" among the different stations (3, 5, W). In general, said transportation system 8 may describe a straight, broken or curvilinear path, according to specific requirements.

In working line 2 according to the present invention, said at least one working station "W" is located between the first manipulation station 3 and the second manipulation station 5.

The present invention ensures, therefore, that upstream and downstream of at least one working station "W", which needs to process open containers, the containers will remain sealed, without any risk of contamination of the fluid product and/or dripping of the fluid product contained in individual containers "C".

The present invention allows for automatic execution of operations for both removing cover and/or lid "L" from the container and re-positioning cover and/or lid "L" onto container "C", preferably without requiring the intervention of a human operator. Working line 2 according to the present invention is preferably completely automated.

In general, said at least one manipulator (4, 6) in working line 2 according to the present invention is adapted to manipulate covers and/or lids "L" associable with said container "C" through joint-type or screw-type means.

In one possible embodiment, both the first manipulation station 3 and the second manipulation station 5 of said working line 2 comprise each at least one manipulator.

In one possible alternative embodiment, said working line 2 comprises a single manipulator, e.g. an automaton and/or humanoid with artificial intelligence. Said single manipulator can manipulate said covers and/or lids "L" at both said first manipulation station 3 and said second manipulation station 5, moving between the two manipulation stations (3, 5).

In general, said at least one manipulator (4, 6) is adapted to work on covers jointed or screwed to the container "C" and/or lids jointed or screwed to the container "C".

Preferably, said manipulators (4, 6) are automated and require no human intervention; for example, they may be humanoid devices and/or automatons with artificial intelligence.

Working line 2 according to the present invention can therefore process different types of containers "C", which may be provided with different possible systems for closing one or more openings.

In a preferred embodiment of working line 2 according to the present invention, the same working line 2 comprises a movement system 7 for moving covers and/or lids "L". Said movement system 7 is adapted to move covers and/or lids "L" at least between said first manipulation station 3 and said second manipulation station 5. Working line 2 according to the present invention allows moving covers and/or lids "L" removed at the first manipulation station 3 towards the second manipulation station 5, so that the removed covers and/or lids "L" can be reused. Preferably, said movement system 7 is automated and does not require, for example, the intervention of human operators. In one possible embodiment, said movement system 7 may be integrated into a single manipulator, which can operate at both said first manipulation station 3 and said second manipulation station 5, by moving between such stations. Said single manipulator, which incorporates said movement system 7, can carry said covers and/or lids "L" that have been removed from containers "C" at said first manipulation station 3, so as to be able to fix again the transported covers and/or lids "L" onto containers "C" at the second manipulation station 5.

Preferably, in order to reduce the risk of contamination, cover and/or lid "L" removed from a container "C" at the first manipulation station 3 will be connected again to the same container "C" when the latter arrives at the second manipulation station 5.

In general, working line 2 according to the present invention is arranged in a manner such that said manipulator 6 of the second manipulation station 5 is adapted to manipulate cover and/or lid "L" removed from a container "C" at the first manipulation station 3, so as to associate cover and/or lid "L" with the same container "C" from which it was removed, thereby closing it.

Therefore, the present solution provides a reduction in wasted material, since it is not necessary to use new lids and/or covers "L" for re-closing containers "C".

In a preferred, but non-limiting, embodiment of working line 2 according to the present invention, said movement system 7 comprises a movement device 71, which is adapted to move, preferably through a sliding action, said covers and/or lids "L" between said first manipulation station 3 and said second manipulation station 5. In one possible embodiment of said movement device 71, it is a conveyor belt or a system of automated slides and/or rollers. Said movement device 71 follows a predefined path, preferably parallel to the path described by transportation system 8 for moving containers "C". As an alternative, said movement device 71 may follow an alternative path, possibly the shortest path between the two manipulation stations (3, 5).

Said movement system 7 further comprises at least two conveyance systems 72. Each one of said conveyance systems is adapted to allow said covers and/or lids "L" to be properly transferred from said manipulator (4, 6) to the movement device 71, and vice versa. Said conveyance systems 72 connect the operations carried out by manipulators (4, 6) with the one carried out by movement system 7. In particular, a first conveyance system 72 is adapted to convey cover and/or lid "L" removed by said manipulator 4 comprised in the first manipulation station 3, placed on a suitable seat 73, until it reaches an appropriate position on movement device 71 of movement system 7; whereas a second conveyance system 72 is adapted to convey cover and/or lid "L", once it has arrived at the second manipulation station 5 by means of said movement device 71, until it reaches a seat 73, from which it can be properly gripped by said manipulator 6 comprised in the second manipulation station 5.

Said movement system 7 further comprises a plurality of anti-dripping systems 74. Said anti-dripping systems 74 are adapted to avoid that, at least as said covers and/or lids "L" are moving between the conveyance systems 72 and manipulators (4, 6), part of the fluid product might soil containers "C", said covers and/or lids "L", and/or part of working line 2.

In a first exemplary, but non-limiting, embodiment, said anti-dripping systems 74 comprise a plurality of plates, at least one in proximity to each conveyance system 72, which can be positioned under cover and/or lid "L" during the movement thereof, effected by the manipulator (4, 6), from the container to conveyance system 72, and vice versa. In particular, there is a first plate adapted to be positioned under said cover and/or lid "L" when said manipulator 4 of the first manipulation station 3, after having manipulated said cover and/or lid "L" in order to remove it from container "C", moves said cover and/or lid "L" towards a seat 73 for feeding it into conveyance system 72. There is also a second plate adapted to be positioned under said cover and/or lid "L" when said manipulator 6 of the second manipulation station 5, before manipulating said cover and/or lid "L" in order to associate it with the container, moves said cover and/or lid "L" from conveyance system 72, and in particular from seat 73, towards container "C" in order to couple it to the same container "C". Therefore, said movement system 7, and in particular said anti-dripping systems 74, also comprise at least two seats 73; at least one for each manipulation station (3, 5) whereon cover and/or lid "L" can be positioned, so that it can be moved from a manipulator (4, 6) and/or from a conveyance system 72. Such seat 73 comprises at least one housing with edges having a diameter substantially equal to the diameter of cover and/or lid "L", so that the same cover and/or lid "L" can abut against its outer edges, which have not come in contact with the fluid product, thereby preventing those portions of cover and/or lid "L" on which part of the fluid product may potentially remain from touching any surfaces that might be soiled with fluid product and, most importantly, avoiding that said fluid product might soil other covers and/or lids "L" placed in the same position, which would otherwise be contaminated.

In a preferred embodiment, said at least two conveyance systems 72 are adapted to overturn said cover and/or lid "L". The present solution ensures that the covers and/or lids "L" arriving at movement device 71 will be so oriented as to rest on movement device 71 with their outer surface, i.e. that surface which cannot be soiled with fluid product when the same cover and/or lid "L" is associated with container "C". Moreover, the present solution ensures that cover and/or lid "L" will be re-positioned in such a way that manipulator 6, comprised in the second manipulation station 5, will be easily able to pick up cover and/or lid "L" without getting soiled and to position it immediately onto container "C". Preferably, cover and/or lid "L" is positioned onto the same container "C" from which it was removed. This solution simplifies the movement of manipulators (4, 6) comprised in manipulation stations (3, 5).

In one possible exemplary, but non-limiting, embodiment, said conveyance system 72 is adapted to vary the height at which the lid is positioned after having been conveyed. In particular, the movement that allows overturning cover and/or lid "L" requires a change in height in order to reach the final position, e.g. a downward movement to a lower height is effected for switching from said seat 73 to said movement device 71; conversely, an upward movement to a higher height is effected for switching from said movement device 71 to said seat 73.

In alternative embodiments there is a conveyance system 72 that keeps the cover and/or lid at the same height, while nevertheless overturning cover and/or lid "L".

In one possible exemplary, but non-limiting, embodiment of working line 2, said manipulator (4, 6) in turn comprises: at least one gripping device (43, 63), adapted to grip a cover and/or lid "L"; an actuating device (44, 64) capable of decoupling and/or coupling said cover or lid "L" from/to associated container "C". Said manipulator (4, 6) further comprises a movement device (45, 65) adapted to move cover or lid "L" away and/or towards container "C", e.g. so that cover and/or lid "L" can be put into and/or picked up from said seat 73.

In a preferred, but-non limiting, embodiment, each manipulation station (3, 5) comprises a first manipulator, adapted to manipulate covers, and a second manipulator, independent of the first one, capable of manipulating lids. Preferably, the manipulator adapted to manipulate covers is adapted to manipulate covers associated with container "C" by pressure, more particularly covers adapted to be associated with containers that, in the internal peripheral edge portion of their top wall define an annular cavity that is open at the top for receiving the bottom surface of an annular channel, also open at the top, comprised in the cover. In its turn, the cover includes a deformable portion, protruding from said cavity, through which the cover can be disengaged from the top wall of the container.

Conversely, the manipulator adapted to manipulate lids is adapted to manipulate lids screwed to container "C" or to a cover associated, preferably by pressure, with container "C".

In an exemplary, but-non limiting, preferred embodiment, said first manipulation station 3 comprises a first manipulator adapted to remove covers, in particular pressure-type covers, and a second manipulator adapted to remove lids, in particular screw-type lids. In the same embodiment, said second manipulation station 5 comprises a first manipulator adapted to fix covers, in particular pressure-type covers, and a second manipulator adapted to tighten lids, in particular screw-type lids.

In an embodiment of working line 2 according to the present invention, and in particular of manipulation stations (3, 5) having a manipulator (4, 6) adapted to manipulate a screw-type lid, said actuating device (44, 64) is adapted to make a rotary movement in order to couple and/or decouple a screw-type lid "L" to/from a container "C".

In an embodiment of working line 2 according to the present invention, and in particular of manipulation stations (3, 5) having a manipulator (4, 6) adapted to manipulate a pressure-type lid, said actuating device (44, 64) is adapted to make a linear movement in order to couple and/or decouple a pressure-type lid "L" to/from a container "C".

In an exemplary, but non-limiting, preferred embodiment of working line 2 according to the present invention, said at least one working station "W" is at least one station for dosing a fluid product.

In a preferred embodiment, said working line 2 comprises at least two working stations "W", which are dosing stations.

In general, such dosing stations can deliver predetermined quantities of different fluid products, e.g. dyes of different shades and/or colours.

In an exemplary, but non-limiting, preferred embodiment of working line 2 according to the present invention, said transportation system 8 is a motorized roller-type system.

Preferably, said rollers are put in rotation by means of a chain-type system.

In one possible exemplary, but non-limiting, embodiment, said working line may comprise a marking machine 21, adapted to affix a distinctive sign, e.g. a mark and/or a barcode, preferably by means of an adhesive, onto container "C" in working line 2.

Describing the construction more in detail, said manipulator 4, adapted to remove a screw-type lid from a container "C", comprises at least one gripping device 43 adapted to grip lid "L".

Said manipulator 4 further comprises an actuating device 44 capable of decoupling said lid "L" from container "C" with which it is associated. Said manipulator 4 further comprises a movement device 45 adapted to move cover and/or lid "L" away from container "C", e.g. in order to place it into a seat 73.

In order to remove lid "L" from a container that has arrived at the first manipulation station 3, said manipulator 4 is moved by means of said movement device 45, in particular lowered over the lid. Manipulator 4 is moved until gripping device 43 comes into contact with and grips lid "L".

After having gripped lid "L", said actuating device 44 is activated in order to decouple lid "L". Preferably, said actuating device 44 is adapted to rotate said gripping device 43 about the axis of lid "L". This rotary movement, appropriately controlled, allows lid "L" to be unscrewed from container "C". Gripping device 43 is connected to actuating device 44 in a manner such as to be able to compensate for the movement along the axis of rotation of the lid as the latter is being removed.

In one possible embodiment, said gripping device 43 comprises at least two gripping elements 431. Said gripping device 43 is adapted to take two operating configurations: a first operating configuration, in which said gripping elements 431 are not adapted to act upon said lid "L", in particular upon the lateral edges of the lid; and a second operating configuration, in which said gripping elements 431 are adapted to act upon the lateral edges of lid "L".

The movement of gripping elements 431 between the different operating configurations is effected by means of a system of levers that allow acting upon the lateral edges of lid "L" following the positioning of gripping device 43 on lid "L".

In the same embodiment, said movement device 45 comprises a first movement device 451, which allows gripping device 43 to be moved towards and away from container "C", preferably along a vertical axis "Z". The movement made by the first movement device 451 allows gripping device 43 to interact with lid "L" and/or to be moved away from the same container "C".

In one possible embodiment, said gripping device 43 is a clamp-type system, preferably a pneumatic one. In a preferred embodiment, said gripping device 43 comprises two or more, preferably three, gripping elements 431, e.g. claws.

Manipulator 4 exerts no voluntary forces on the edge of the outer top wall of container "C" and/or of the portion whereon lid "L" is screwed.

Said actuating device 44 is adapted to move at least two gripping elements 431 of gripping device 43. In particular, said actuating device 44 is adapted to move gripping device 43 by turning it about an axis coinciding with the axis of lid "L".

In a preferred embodiment of manipulator 4, actuating device 44 comprises an actuator device 442 and at least one compensation system 444.

Said actuating device 44 is an electric motor, preferably of the brushless type, which can be controlled as to the number of revolutions and the torque applied for rotating said gripping device 43 in order to unscrew lid "L". Said compensation system 444 is adapted to compensate for the movements occurring along said vertical axis, caused by the threaded portions through which lid "L" is secured to container "C". In this manner, during the unscrewing operation actuating device 44 can compensate, by means of compensation system 444, for the upward movement made by lid "L" as it is unscrewed. Likewise, the compensation system will be able to compensate for a downward movement of the lid during the screwing operation. Said compensation system 444 comprises elastic elements adapted to compensate for such movements.

Said movement device 45 is, for example, a pneumatic or oil-pressure system. In addition to the first movement device 451, said movement device 45 comprises a frame capable of moving said manipulator 4 in at least one plane. One possible embodiment comprises a second actuator device capable of moving said manipulator 4 along a horizontal axis, e.g. in order to reach said seat 73. In an alternative embodiment, said movement device 45 comprises a robotic arm.

Manipulator 4 further comprises a centring device 41, which may comprise an electronic control system adapted to identify the position of lid "L", e.g. the proper positioning thereof, and to allow for the subsequent movement of manipulator 4 towards lid "L".

After lid "L" has been completely removed from container "C", manipulator 4 is moved, by means of said movement device 45, in order to place said lid "L" onto movement system 7.

In particular, manipulator 4 is moved in a manner such as to place lid "L" onto a suitable seat 73. As lid "L" is moved from the container to seat 73, anti-dripping systems 74, in particular at least one plate, is positioned under lid "L" during the movement effected by manipulator 4, so as to avoid that part of the fluid product might soil the container and/or part of the first manipulation station 3 and/or of transportation system 8. In one possible embodiment, said plate of the anti-dripping system 74 comprises a tank for collecting any fluid product dripping from lid "L". Also said seat 73 comprises a tank, small in size, for collecting any fluid product that may drip.

In much the same manner, manipulator 6 comprised in the second manipulation station 5, which is adapted to tighten a screw-type lid onto a container "C", comprises at least one gripping device 63, adapted to grip lid "L".

Said manipulator 6 further comprises an actuating device 64 capable of tightening said lid "L" onto container "C" with which it must be associated.

Said manipulator 6 further comprises a movement device 65 adapted to move lid "L" closer to container "C". In order to associate lid "L" with a container "C" that has arrived at the second manipulation station 5, said manipulator 6 is moved, in particular lowered, by said movement device 65, so that it can pick up lid "L" from a suitable seat 73 comprised in movement system 7 comprised in said second manipulation station 5. Once lid "L" on said seat 73 has been gripped, manipulator 6 moves in such a way as to position itself over container "C", so as to be able to associate said lid "L" with container "C". As lid "L" is moved from seat 73 towards container "C", anti-dripping systems 74, in particular at least one plate, positions itself under the lid "L" during the movement effected by the manipulator 4, so as to avoid that part of the fluid product might soil the container and/or part of the first manipulation station 3 and/or of transportation system 8.

While holding the lid "L" over the opening onto which it will have to be screwed, manipulator 6 is lowered towards container "C" by said movement device 65.

Manipulator 6 is moved until the threaded portion of lid "L" fits the corresponding threaded portion on container "C", or cover, onto which the lid must be screwed.

Once the threaded portions have been coupled together, said actuating device 64 is activated in order to tighten lid "L". Preferably, said actuating device 64 is adapted to rotate said gripping device 63 about the axis of lid "L". This rotary movement, appropriately controlled, allows lid "L" to be tightened onto container "C". Gripping device 63 is connected to actuating device 64 in a manner such as to be able to compensate for the movement along the axis of rotation of the lid as the latter is being tightened.

The structural characteristics of manipulator 6 comprised in the second manipulation station 5, are substantially the same as those of manipulator 4 comprised in the first manipulation station 4; therefore, the structural characteristics of manipulator 6 will not be described any further herein, since they can be inferred from the above description.

With reference to movement system 7 comprised in the first manipulation station 3, lid "L", once it has been positioned on said seat 73, can be handled by conveyance system 72, so that it can reach movement device 71.

In one possible embodiment of conveyance system 72, it comprises, arranged near said first manipulation station 3 adapted to remove screwed-on lids, an actuator 722 adapted to move said seat 73 in a manner such that lid "L" will be conveyed, by means of a suitable guide 724, onto movement device 71. In the preferred embodiment, said actuator 722 is adapted to move said seat 73, which is pivoted to and rotatable about an axis, so as to tilt the same seat 73. A guide 724 is arranged underneath said seat 73, so that, once said seat 73 has been tilted, lid "L" will slide from said seat and run into said guide 724, which is a suitably shaped tunnel. The curvature of guide 724 is adapted to cause lid "L" to turn over, so that it will arrive upside-down at movement device 71, compared to its previous position on said seat 73. In this embodiment, said conveyance system 72 moves lid "L" from a higher height to a lower height. Once lid "L" has been placed onto said movement device 71, the same lid is brought to the second manipulation station 5, so that it can be associated again with container "C", in particular the same container "C" from which it was removed. Said movement device 71 may be straight or may include direction changes, in addition to height variations.

Lid "L", once it has arrived at the second manipulation station 5, can be handled by conveyance system 72, so that it can reach a seat 73.

In one possible embodiment of conveyance system 72, it comprises, arranged near said second manipulation station 5, an actuator 722 capable of moving lid "L" from movement device 71, so that lid "L" will be conveyed, by means of a suitable guide 724, onto seat 73.

In the preferred embodiment, said actuator 722 is adapted to push lid "L" into a guide 724, so that it will reach said seat 73, which is fixed. Guide 724 is located between said movement device 71 and said seat 73, so that, under the thrust exerted by said actuator 722, lid "L" will slide in said guide 724, which is a tunnel suitably curved to allow the lid to arrive at said seat 73. The curvature of guide 724 is adapted to allow lid "L" to turn over, so that it will arrive upside-down at seat 73, compared to its previous position on said movement device 71. In this embodiment, said conveyance system 72 moves lid "L" from a lower height to a higher height.

In a preferred embodiment, said actuator 722 is a rotary arm turning about an axis, which can push lid "L" along said guide 724, which describes a circumference sector, preferably a semi-circumference.

Once it has been placed onto said seat 73, lid "L" can be manipulated by manipulator 6 comprised in the second manipulation station 5.

Movement system 7 described so far with reference to lids can also be used for moving covers, with some necessary modifications that will not depart from the protection scope of the present invention.

In general, conveyance system 72 comprised in said first manipulation station 3 is adapted to allow said covers and/or lids "L" to appropriately move from said manipulator 4 to said movement device 71; while conveyance system 72 comprised in said second manipulation station 5 is adapted to allow said covers and/or lids "L" to appropriately move from said movement device 71 to said manipulator 6.

In general, movement device 71, e.g. a conveyor belt, is adapted to transport covers and/or lids "L" in an overturned condition, for the purpose of preventing any dripping of fluid products from the same covers and/or lids "L", so that movement device 71 will not get soiled.

Movement system 7 according to the present invention allows moving cover and/or lid "L" from a first manipulation station 3 to a second manipulation station 5, so that each cover and/or lid "L" is associated with the same container "C" from which it was removed.

Transportation system 8 allows moving containers "C" among the various stations, including manipulation stations (3, 5) and working stations "W". Containers "C", for which covers and/or lids "L" are handled by movement system 7, proceed along working line 2, according to the present invention, open towards the stations, e.g. working stations "W", preferably dosing stations.

Describing more in detail the construction of the embodiment of a manipulator 4 adapted to remove a pressure-type cover from a container "C", said manipulator 4 comprises at least one gripping device 43 adapted to grip a cover; an actuating device 44, capable of decoupling said cover from the associated container "C"; and a movement device 45 adapted to move the cover away from container "C".

Preferably, manipulator 4 further comprises: a centring device 41, adapted to ensure the proper alignment of manipulator 4 over container "C". Said gripping device 43 is adapted to selectively act upon at least two points of a cover of container "C", being thus able to both disengage the cover from container "C" and hold the same cover. Said gripping device comprises a plurality of gripping elements 431, preferably arranged along a circumference.

Said movement device 45 in turn comprises a first movement device 451 adapted to move said gripping device 43 along a vertical axis "Z", between at least one first position, proximal to centring device 41, and at least one second position, remote from the centring device.

Said movement device 45, and in particular said first movement device 451, is of the pneumatic or oil-pressure type.

Manipulator 4 further comprises a support structure 42, fixed to said centring device 41, adapted to support said first movement device 451.

Said gripping device 43 is adapted to take a first operating configuration, wherein it is not adapted to act upon a protruding portion of the cover; and a second operating configuration, wherein it is adapted to act upon a protruding portion of the cover.

Said centring device 41 comprises an abutment portion 412 adapted to abut against an outer top wall of container "C" and also to prevent container "C" from moving, without exerting any pressure force upon said outer top wall of container "C", in any operating configuration or spatial arrangement of gripping device 43.

The movement effected by the first movement device 451 allows gripping device 43 to move closer to or farther from container "C", so that gripping device 43 can interact with cover "L" and/or remove cover "L" by extracting it from container "C" and/or moving it away from the same container "C".

Manipulator 4 exerts no voluntary forces on the edge of the outer top wall of container "C".

Said actuating device 44 is adapted to move at least two gripping elements 431 of gripping device 43 between the different operating configurations of gripping device 43. In particular, said actuating device 44 is adapted to move said gripping device 43 between a first operating configuration, in which said gripping elements 431 are not adapted to act upon said cover "L"; and a second operating configuration, in which said gripping elements 431 are adapted to act upon a protruding portion of the annular channel, open at the top, of cover "L".

In a preferred embodiment of manipulator 4, actuating device 44 comprises an actuator device 442 and at least one actuating element 443.

Said actuating element 443 is adapted to act upon said gripping elements 431 under the action of said actuator device 442.

During its movement, preferably a linear movement, said actuator device 442 acts, through said actuating element 443, upon said gripping elements 431, allowing said gripping elements 431 to selectively take either said first operating configuration or said second operating configuration. Preferably, said actuating element 443 is shaped in such a way as to simultaneously act upon all gripping elements 431, having preferably an annular shape. Said actuator device 442 is preferably a pneumatic or oil-pressure actuator.

Manipulator 6, comprised in the second manipulation station 5, has the same technical characteristics as manipulator 4, comprised in said first manipulation station 3. Therefore, what has been described heretofore with reference to the embodiment of manipulator 4 for removing covers, comprised in the first manipulation station 3, also applies to manipulator 6 for applying covers, comprised in the second manipulation station 5. Furthermore, the sequence of steps described for moving the lid, described with reference to the previous embodiment, is also applicable to the actuators adapted to manipulate a cover.

Likewise, movement system 7 can also be used for moving pressure-type covers removed from containers fed to the first manipulation station 3, which are then associated again with the same container at said second manipulation station 5, by appropriately configuring said movement device 71, said conveyance system 72, said seat 73 and said anti-dripping systems 74.

As an alternative, the covers may, once they have been separated from container "C", be left on the container itself. In this embodiment, the various working stations "W" of the line provide for, while using anti-dripping systems, moving the cover away from the container until the processing of the fluid product is complete. The movements of the cover can be effected through suitable actuators, e.g. suction-cup or magnetic ones. When processing is over, the cover is laid again on the container, without closing it yet. The container will be definitively closed, by fixing the cover again to container "C", at the second manipulation station 5.

Working line 2 according to the present invention is particularly suited to implement a method for manipulating a pre-dosed container.

In one possible implementation of the method according to the present invention, said method comprises the following steps:

- removing a cover and/or lid "L" from a pre-dosed container "C" of a fluid product at a first manipulation station 3, in particular by means of a manipulator 4;
- conveying said cover and/or lid "L" by means of a movement system 7, preferably towards a second manipulation station 5;
- moving said container "C" towards a working station "W";
- at said working station "W", executing an operation on said fluid product contained in container "C";
- moving said container "C" towards a second manipulation station 5;
- at said second manipulation station 5, fixing said cover and/or lid "L" onto the container, in particular by means of a manipulator 6, after recovering said cover and/or lid "L" from said movement system 7.

According to the present method, containers "C" are fed to working line 2 or may already be present thereon, e.g. contained in a store associated with the working line 2.

In one possible exemplary, but non-limiting, embodiment, an alignment step is carried out prior to the step of removing a cover and/or lid "L". In such step, the container is properly oriented, e.g. by means of a rotating device comprised in the first manipulation station 3. Moreover, by means of a centring device 41, e.g. an optical system, it is possible to determine the position of the cover and/or lid and move manipulator 4 accordingly. Preferably, said container "C" is moved until the cover and/or lid is aligned with manipulator 4.

The step of removing the cover and/or lid comprises the sub-steps of:

- moving manipulator 4, lowering it over the cover and/or lid;
- tightening the gripping device;
- activating actuating device 44, for the purpose of removing cover and/or lid "L" from the container;
- moving the cover and/or lid away from the container, arranging it onto a suitable seat 73.

The sub-step of moving the cover and/or lid away, e.g. sideways, includes the activation of at least one anti-dripping system 74, e.g. a plate.

During the step of conveying said cover and/or lid "L", conveyance system 72 is activated in a manner such that the cover and/or lid is positioned upside-down on said movement device 71. This will prevent any dripping onto movement device 71 while moving the cover and/or lid.

During the step of moving said container "C", the containers are moved, by means of transportation system 8, towards a working station "W", e.g. dosing stations.

During the step of executing an operation, the devices comprised in working station "W" are suitably activated, so as to carry out an operation on the fluid product contained in container "C", e.g. dosing an additional fluid product.

Downstream of working station "W" there is a second manipulation station 5.

During the step of moving said container "C" towards a second manipulation station 5, said transportation system 8 is suitably activated.

During the step of fixing said cover and/or lid "L", cover and/or lid "L" that has been moved up to the second manipulation station 5 by movement device 71 is recovered by means of conveyance system 72. Conveyance system 72 is activated in order to place the cover and/or lid coming from said movement device 71 onto a suitable seat 73. The cover and/or lid is positioned upside-down on said seat 73, so that it can be easily manipulated by manipulator 6.

Subsequently, the step of fixing said cover and/or lid "L" includes the following sub-steps:

- moving manipulator 6, lowering it over cover and/or lid "L";
- tightening gripping device 63;
- moving cover and/or lid "L" from said seat 73 to container "C", positioning it on container "C";
- activating actuating device 64, for the purpose of tightening cover and/or lid "L" onto the container "C", thereby closing it.

The sub-step of moving the cover and/or lid, e.g. sideways, includes the activation of at least one anti-dripping system 74, e.g. a plate.

When the sub-step of activating actuating device 64 is complete, manipulator 6 is moved in such a way as to not hinder the movement of containers "C" in working line 2, particularly at said second manipulation station 5.

According to this method, the step of fixing said cover and/or lid "L" is carried out in a manner such that cover and/or lid "L" that is fixed onto container "C" is the very same cover and/or lid "L" that was previously removed from the same container "C" at the first manipulation station 3.

The method according to the present invention envisages, in both the step of removing a cover and/or lid "L" and the step of fixing said cover and/or lid "L", a control sub-step. Such control sub-step can control the forces exerted both by gripping devices (43, 63) and by actuating devices (44, 64), so as to avoid damaging the container or the cover and/or lid as they are being removed or fixed.

FIG. 1 shows a front view of one possible exemplary, but non-limiting, embodiment of a working line 2 for fluid products pre-dosed into a container "C". The illustrated embodiment shows two working stations "W", in particular two dosing stations, arranged between a first manipulation station 3 and a second manipulation station 5.

In this figure one can see how container "C" entering working line 2 is manipulated at the first manipulation station 3, by means of a manipulator 4, in order to remove cover and/or lid "L". The station may comprise devices or systems for centring container "C" and/or manipulator 4, so as to allow the removal of cover and/or lid "L". Suitable anti-dripping systems 74 prevent parts of working line 2 and/or container "C" itself from being soiled with fluid product. The container then arrives at a working station "W", where, for example, a fluid and/or powder product is dosed.

Subsequently, according to specific requirements, the container may arrive at another working station "W" or at the second manipulation station 5. In this second manipulation station 5, cover and/or lid "L", preferably the same that was removed at the first manipulation station 3, is fixed again, by means of a manipulator 6, onto container "C". In this case as well, suitable anti-dripping systems 74 prevent container "C" and/or working line 2 from getting soiled with fluid product. The movement of the containers among the various stations occurs by means of a transportation system 8, e.g. a chain-driven or belt-driven roller-type system.

Figure 2:
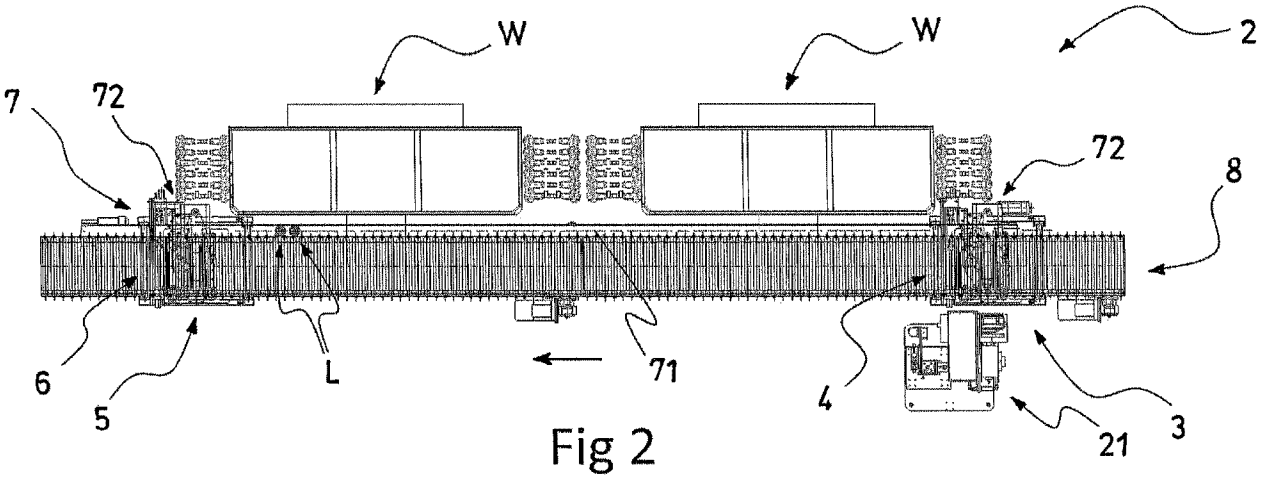
FIG. 2 shows a top view of the working line according to the present invention.

FIG. 2 shows a top view of working line 2, e.g. the same working line shown in FIG. 1.

In this figure it is possible to see one possible embodiment of movement system 7.

In this figure one can see, in proximity to the first manipulation station 3, a conveyance system 72 capable of appropriately moving covers and/or lids "L" from manipulator 4 to movement device 71.

In the illustrated embodiment, said movement device 71 follows a path that is parallel to the straight one described by said transportation system 8, as can be seen in FIG. 2.

As shown in the drawing, at the opposite end of said movement device 71 there is the second manipulation station 5, whereat covers and/or lids "L" removed at the first manipulation station "C" arrive in order to be connected again to the containers "C", preferably the same containers "C" from which they were removed. The drawing shows a conveyance system 72 adapted to prepare cover and/or lid "L" for being gripped and manipulated by manipulator 6.

The drawing also shows two working stations "W" arranged between two manipulation stations (3, 5).

Figure 3:
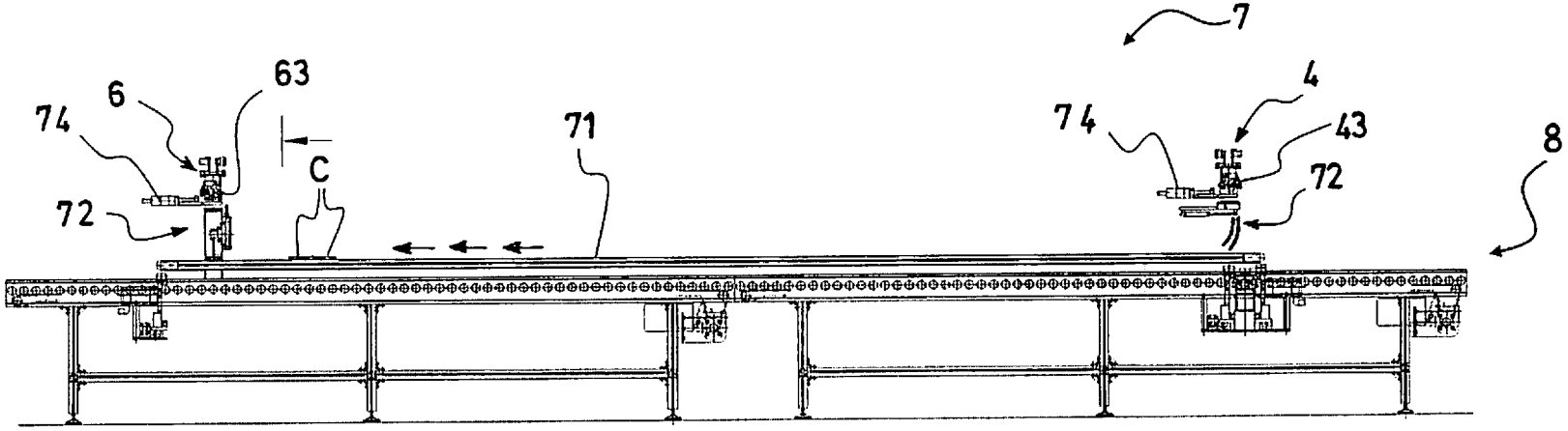
FIG. 3 shows a front view of the system for moving the covers and/or lids applicable between two manipulation stations comprised in the working line according to the present invention.

FIG. 3 shows a front view of movement system 7 for moving covers and/or lids "L" between the two manipulation stations (3, 5) comprised in working line 2 according to the present invention.

This figure shows only movement system 7 and the gripping devices (43, 63), comprised in the respective manipulators (4, 6) of the two manipulation stations (3, 5), and transportation system 8.

In proximity to gripping device 43 of manipulator 4 comprised in the first manipulation station 3, there are an anti-dripping system 74, in particular a plate with a collection tank, and a conveyance system 72, adapted to overturn cover and/or lid "L" before it is deposited onto movement device 71.

At the opposite end, in proximity to gripping device 63 of manipulator 6 comprised in the second manipulation station 5, there are an anti-dripping system 74, in particular a plate with a collection tank, and a conveyance system 72, adapted to overturn cover and/or lid "L" as it is moved from movement device 71 towards a seat 73, to be then picked up by manipulator 6.

Furthermore, said movement device 71 remains at the same height along its whole extension, just like said transportation system 8. Alternative embodiments with direction and/or height changes may nevertheless be implemented as well.

Figure 4A:
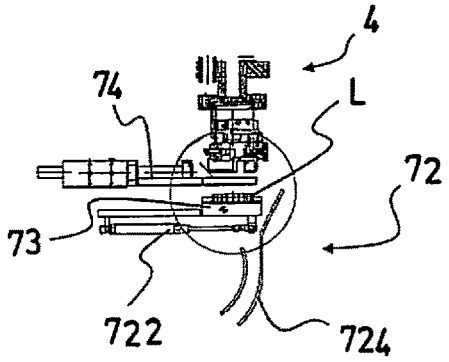
FIGS. 4A-4E show some details of the system for moving the covers and/or lids; in particular.

FIG. 4A shows conveyance system 72 of the first manipulation station 3 in a first operating configuration. In this figure one can see that manipulator 4 has placed a cover or a lid "L" onto a seat 73. Manipulator 4, as it moves in order to place cover and/or lid "L" onto seat 73, is followed by an anti-dripping system 74 in order to prevent movement system 7, other parts of working line 2 and/or container "C" from getting soiled with fluid product.

Conveyance system 72 comprises an actuator 722, adapted to move said seat 73, and a guide 724, the latter being adapted to guide cover and/or lid "L" from seat 73, from which it falls, down to movement device 71.

Figure 4B:
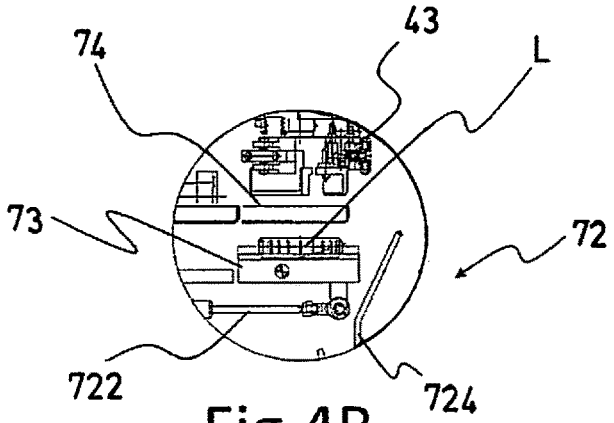

FIG. 4B shows a magnification of conveyance system 72. In this figure one can see gripping device 43 of manipulator 4, under which there is an anti-dripping system 74, in particular a plate.

FIG. 4B also shows the connection between actuator 722 and seat 73 on which a cover and/or lid "L" has been laid. In conveyance system 72 illustrated in the drawing, seat 73 is pivoted in a manner such that it can rotate about an axis following the movement imparted by actuator 722. The figure also shows a part of guide 724, adapted to guide cover and/or lid "L" towards movement device 71.

Figure 4C:
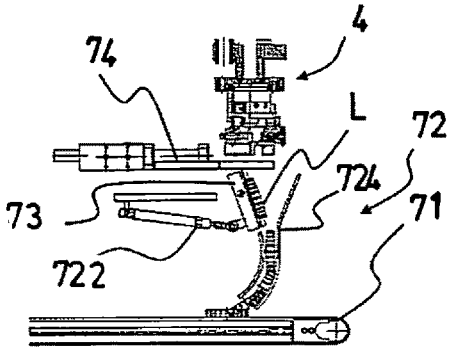

FIG. 4C shows conveyance system 72 of the first manipulation station 3 in a second operating configuration. In this figure one can see that actuator 722 has caused said seat 73 to turn in such a way that cover and/or lid "L" can enter said guide 724. Guide 724 is so designed as to guide cover and/or lid "L" onto movement device 71, so as to rest upside-down compared to the previous position of the same cover or lid "L" on seat 73. Movement device 71 is, for example, a conveyor belt.

In the present embodiment, conveyance system 72, comprised in the first manipulation station 3, conveys cover or lid "L" from a first height to a second height along the vertical axis, wherein said first height is higher than said second height.

Figure 4D:
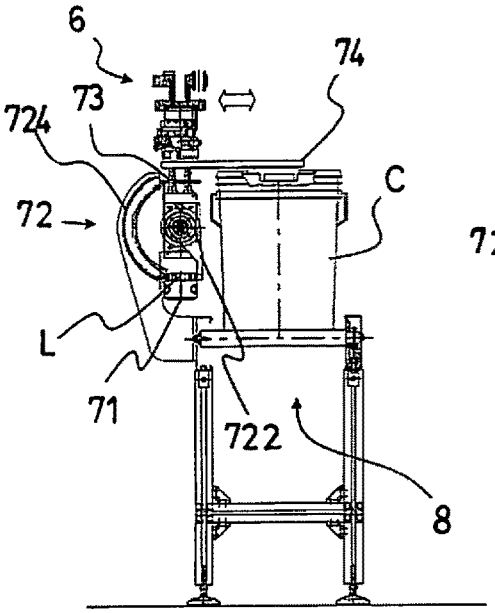

FIG. 4D shows conveyance system 72 comprised in the second manipulation station 5 in a first operating configuration. In this figure one can see cover and/or lid "L" that, by sliding on movement device 71, arrives at conveyance system 72. Through an actuator 722, the cover and/or lid is pushed into a guide 724, which guides cover or lid "L" towards a seat 73. The drawing shows actuator 722 ready to act upon cover or lid "L" for pushing it into said guide 724. The drawing also shows manipulator 6 positioned near seat 73. Manipulator 6 is ready to pick up cover and/or lid "L" brought there by conveyance system 72. The same manipulator 6 can connect said cover and/or lid "L" onto container "C". During these movements, manipulator 6 is followed by an anti-dripping system 74, e.g. a plate, to prevent working line 2 and/or container "C" from getting soiled.

Figure 4E:
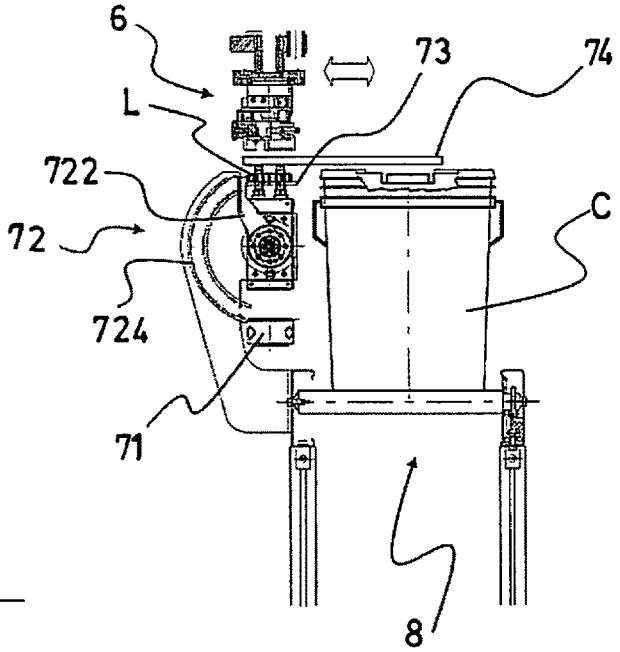

FIG. 4E shows a magnification of conveyance system 72 in a second operating configuration. In particular, it shows actuator 722, which, by rotating about an axis, has pushed cover or lid "L" into guide 724 in order to lead it to seat 73. Said guide 724 is so designed as to guide cover and/or lid "L" onto seat 73 in a manner such that it rests upside-down compared to the previous position of the same cover or lid "L" on movement device 71. In this position 73, cover and/or lid "L" can be manipulated by manipulator 6 in order to be fixed to container "C".

In the present embodiment, conveyance system 72, comprised in the second manipulation station 5, conveys cover and/or lid "L" from a first height to a second height along the vertical axis, wherein said first height is lower than said second height.

Figure 5B:
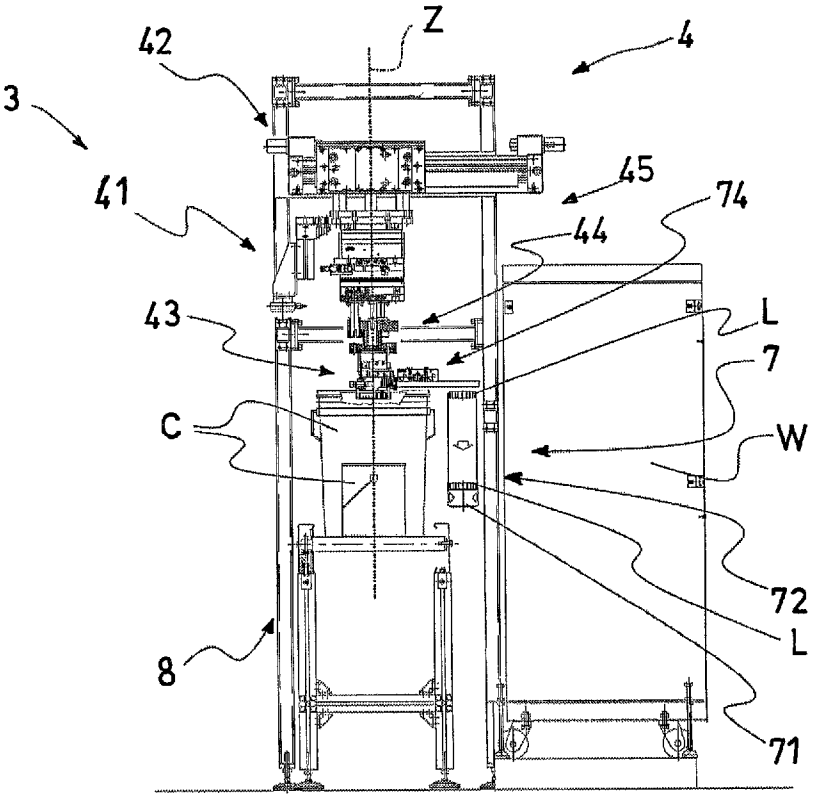
FIGS. 5A, 5B show a side view of one possible embodiment of a manipulation station for manipulating the cover and/or lid, wherein the manipulator device is visible in two operating configurations.
Figure 5A:
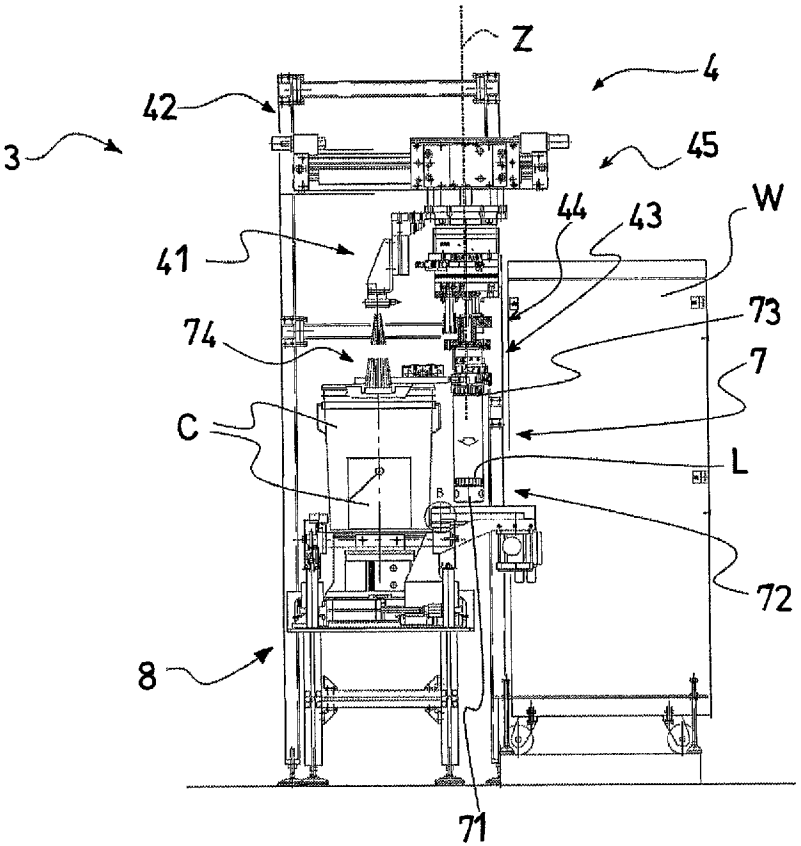

FIG. 5A shows a side view of one possible embodiment of a first manipulation station 3, wherein one can see manipulator 4 in an identification operating configuration. With appropriate modifications, as previously described, this figure may also represent, in a similar manner, a second manipulation station 5.

In the drawing one can see that there are two different types of containers "C", having also different volumes, placed on transportation system 8.

In the illustrated embodiment, centring device 41 is implemented as an optical device, which comprises a display device, e.g. a video camera, capable of identifying the position of cover and/or lid "L" in order to allow manipulator 4 to manipulate it. In one possible embodiment, said centring device 41 comprises an actuator capable of causing container "C" to rotate until cover or lid "L" gets positioned in a specific area monitored by a video camera. Such area is preferably reachable by means of a single linear movement of manipulator 4. As an alternative, said centring device 41 is adapted to identify the relative position of cover and/or lid "L", e.g. by providing the spatial coordinates thereof, so that manipulator 4 will be able to reach it by making movements with several degrees of freedom.

The figure shows a movement device 45 adapted to allow manipulator 4 to move in at least one plane defined by support structure 42, to which manipulator 4 is fixed.

FIG. 5A also shows manipulator 4 positioned over a seat 73, onto which the same manipulator 4 can place a cover and/or lid "L". Said seat 73 belongs to a movement system 7 for such lids and/or covers "L". Said movement system 7 comprises a conveyance system 72. In the illustrated embodiment, said conveyance system 72 can change the height of cover and/or lid "L" along a vertical axis in order to reach movement device 71 that will bring cover and/or lid "L" to a second manipulation station 5.

As can be seen in the drawing, movement system 7 is located between transportation system 8 for transporting containers "C" and working stations "W" of working line 2. Thus, covers and/or lids "L" being moved by movement device 71 are not easily accessible to third parties and are less subject to external contamination.

FIG. 5B shows a side view of one possible embodiment of a manipulation station, in particular a first manipulation station 3, wherein one can see manipulator 4 in an alignment operating configuration.

FIG. 5B shows manipulator 4, which can, through gripping device 43 appropriately driven by actuating device 44, remove said cover and/or lid "L", in particular a lid, from container "C". By comparing FIG. 5B with FIG. 5A it is possible to comprehend one possible embodiment of the movement device, for moving gripping device 43 along both a vertical axis and a horizontal axis in order to place cover and/or lid "L", removed from the container, onto seat 73.

The comparison between FIGS. 5A and 5B allows understanding further construction details, which will not be described in detail hereinafter, since they can be easily understood from the drawings in the light of the present description.

Figure 6C:
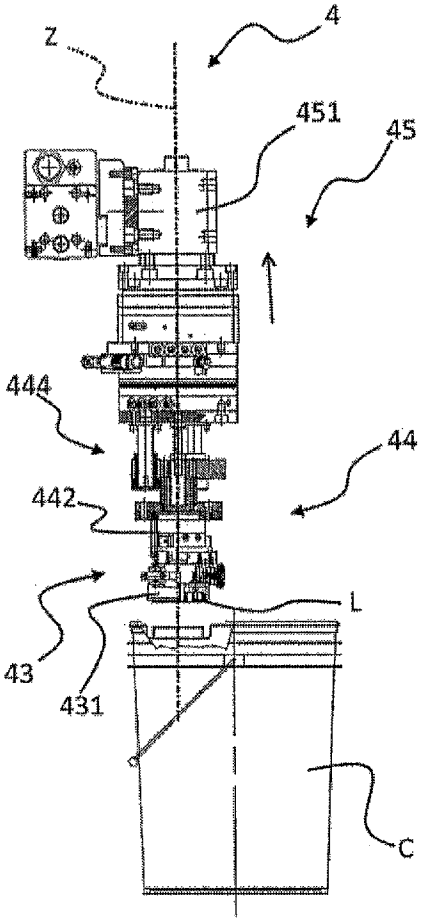
FIGS. 6A-6C show the sequence of movements made by the manipulator in order to remove a lid from a pre-dosed container; in particular.
Figure 6B:
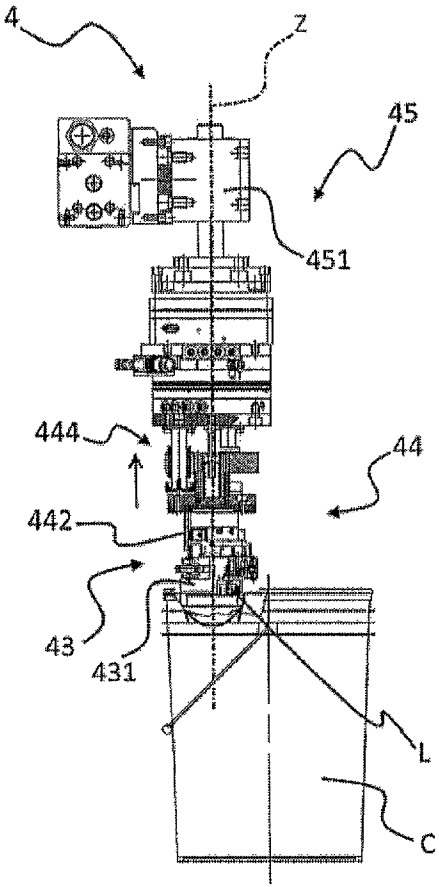
Figure 6A:
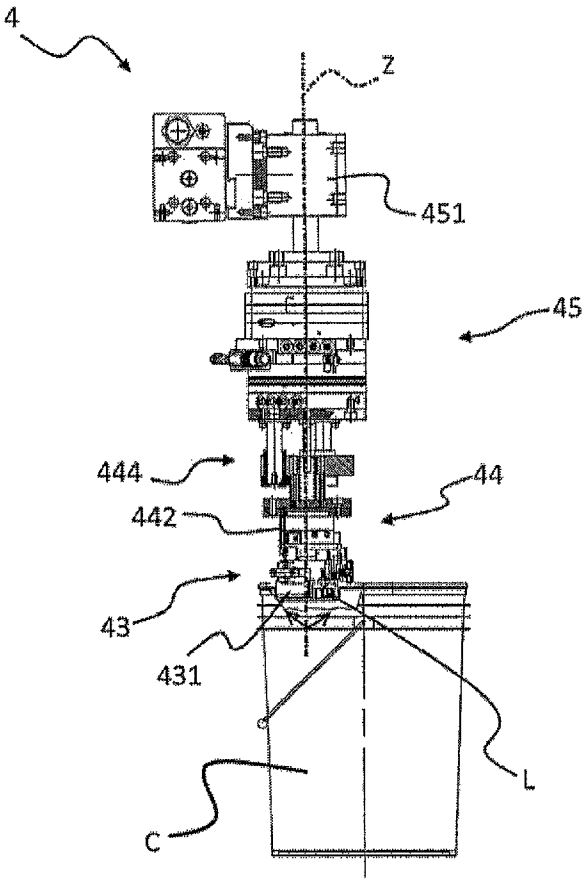

FIG. 6A shows an embodiment of a manipulator capable of manipulating screw-type lids.

FIG. 6A shows manipulator 4 engaging lid "L" that will have to be removed from container "C". In this figure it can be seen that the first movement device 451 is extended to allow gripping device 43 to act upon lid "L", in particular upon the side walls of the same lid.

The drawing shows one possible arrangement of actuating device 44 and of the devices thereof, with respect to gripping device 43.

FIG. 6B shows manipulator 4 during a step of unscrewing lid "L" from container "C". In the present image, when compared with FIG. 6A, it is possible to see how, during the rotation of gripping device 43, manipulator 4 has, by means of actuating device 44, compensated for the upward movement of lid "L" caused by the threaded portions. Said actuating device 44 comprises an actuator device 442 and at least one compensation system 444. Actuator device 442 makes it possible to rotate gripping device 43, while compensation system 444 makes it possible to compensate for the movements of lid "L" by moving gripping device 43 and said actuating device 44 accordingly.

FIG. 6C shows manipulator 4 after it has separated lid "L" from container "C". In this figure it can be seen how, through the first movement device 451, lid "L" can be moved away from container "C".

By comparing FIGS. 6A-6C it is possible to comprehend the relative movements of the various parts of manipulator 4 for separating lid "L" from container "C".

The same sequence, in reverse order, allows creating an actuator 6 capable of fixing a lid "L" to a container "C", in a way similar to that previously described.

Figure 7C:
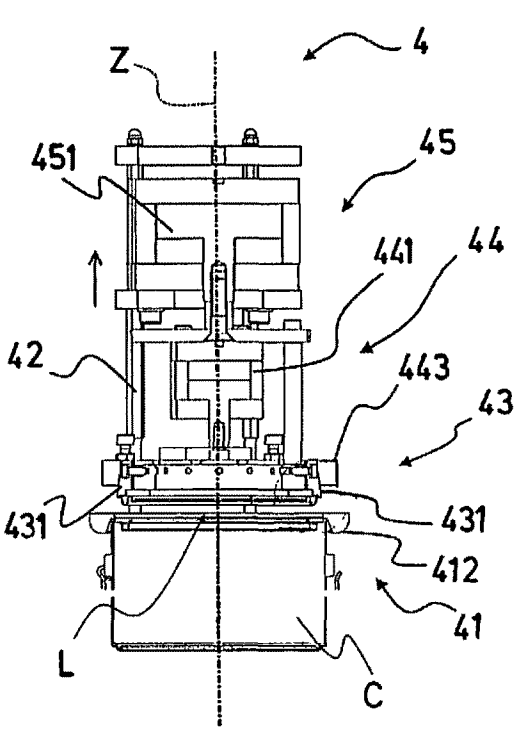
FIGS. 7A-7C show the sequence of movements made by the manipulator in order to remove a cover from a pre-dosed container; in particular.
Figure 7B:
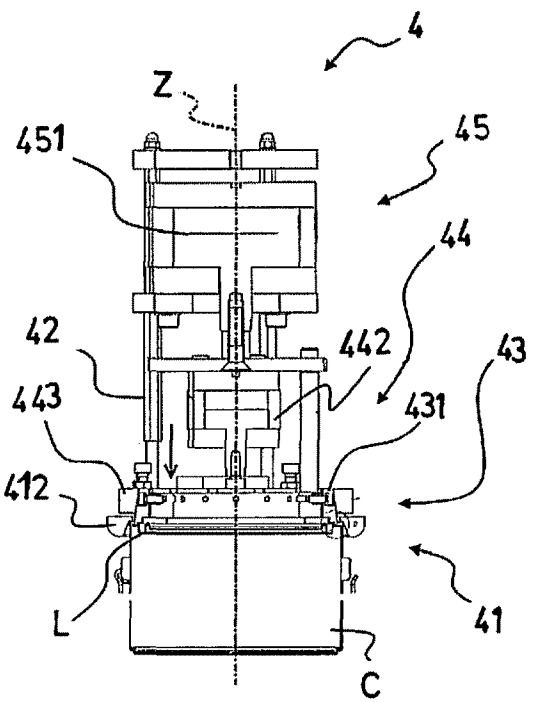
Figure 7A:
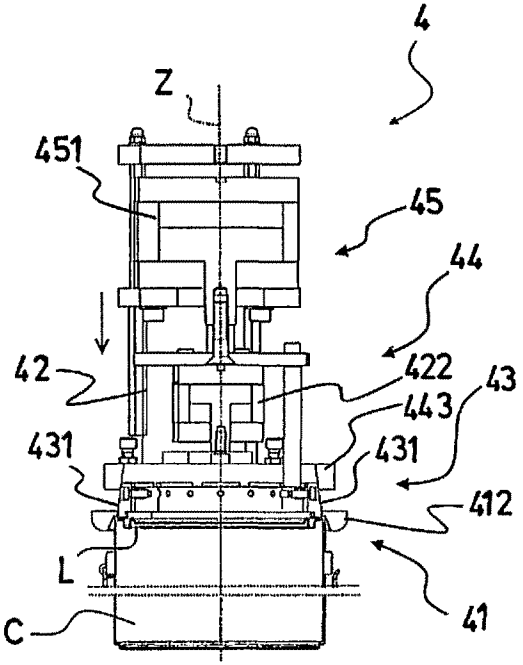

FIG. 7A shows an embodiment of the manipulator capable of manipulating covers "L".

The figure shows manipulator 4 engaging cover "L" that will have to be removed.

In this figure one can see how to make a device for removing covers by means of pneumatic or oil-pressure systems.

As shown in the drawing, the first movement device 451 is extended to allow gripping device 43 to position itself in proximity to cover "L", so as to be able to act upon said cover "L", in particular upon an annular channel, open at the top, comprised in cover "L".

The drawing shows one possible arrangement of actuating device 44 and of the devices thereof, with respect to gripping device 43.

From this figure it is possible to understand that said gripping device 43 comprises a plurality of gripping elements 431, arranged around a circumference.

FIG. 7B shows manipulator 4 acting upon cover "L" of container "C" in order to separate them.

In the present image, when compared with FIG. 7A, it is possible to make out how actuating device 44, comprising an actuator device 442 and at least one actuating element 443, acts upon said plurality of gripping elements 431. Actuator device 442 allows moving said actuating element 443, which simultaneously acts upon said gripping elements 431, causing them to abut against the protruding portion of cover "L".

FIG. 7C shows manipulator 4 after it has separated cover "L" from container "C". In this figure one can see that actuator device 442 is keeping said actuating element 443 in the configuration in which it pushes said plurality of gripping elements 431, thus acting upon said cover "L". Through the action of said first movement device 451 it is possible to definitively move said cover "L" away from container "C".

The technical features of working line 2 and of the devices comprised therein that have been described and illustrated herein are exemplary and non-limiting only, since they will allow a person skilled in the art to include numerous possible alternative technical solutions, which will nonetheless still fall within the protection scope of the present patent application.

REFERENCE NUMERALS

Working line 2
Marking machine 21
First manipulation station 3
Manipulator 4
Centring device 41
Abutment portion 412
Support structure 42
Gripping device 43
Gripping elements 431
Actuating device 44
Actuator device 442
Actuating element 443
Compensation system 444
Movement device 45
First movement device 451
Second manipulation station 5
Manipulator 6
Gripping device 63
Actuating device 64
Movement device 65
Movement system 7
Movement device 71
Conveyance system 72
Actuator 722
Guide 724
Seat 73
Anti-dripping systems 74
Transportation system 8
Containers C
Cover/lid L
Axis Z

The invention claimed is:

1. Working line for fluidic or fluid products contained in pre-dosed containers, wherein said container comprises at least one cover and/or one lid for closing the container;

said working line comprising:

a first manipulation station comprising at least one manipulator adapted to manipulate said cover and/or lid to remove said cover and/or lid from said container, thereby opening the container;

at least one working station adapted to carry out at least one operation on the fluid product contained in the container after removal of said cover and/or lid from the container;

a second manipulation station comprising at least one manipulator adapted to manipulate said cover and/or lid to associate said cover and/or lid with said container, thereby closing the container;

a transportation system adapted to move the pre-dosed containers among the different stations;

said at least one working station is located between said first manipulation station and said second manipulation station;

said at least one manipulator is adapted to manipulate covers and/or lids associable with said container through a joint-type and/or screw-type device;

a movement system adapted to move covers and/or lids at least between said first manipulation station and said second manipulation station; said movement system comprising:

at least one movement device adapted to move said covers and/or lids between said first manipulation station and said second manipulation station;

at least two conveyance systems adapted to move said covers and/or lids between said manipulator and said movement device;

a plurality of anti-dripping systems adapted to avoid prevent, at least while said covers and/or lids are being moved between the conveyance systems and the manipulators, part of the fluid product from soiling the containers, said covers and/or lids, and/or part of the working line;

wherein said manipulator of said second manipulation station is adapted to manipulate the cover and/or lid removed from a container at said first manipulation station to associate the cover and/or lid with the same container from which the cover and/or lid was removed, thereby closing the container; and wherein said at least two conveyance systems are adapted to overturn said cover and/or lid.

2. The working line according to claim 1, wherein said manipulator comprises:

at least one gripping device, adapted to grip a cover and/or lid;

an actuating device decoupling and/or coupling said cover and/or lid from/to the associated container;

a movement device moving the cover and/or lid away and/or towards the container.

3. The working line according to claim 2, wherein said actuating device rotates to couple and/or decouple a screw-type lid to/from a container.

4. The working line according to claim 2, wherein said actuating device moves linearly to couple and/or decouple a pressure-type cover to/from a container.

5. The working line according to claim 1, wherein:

said at least one working station is a station for dosing a fluid or powder product;

said transportation system is a motorized roller-type system.

6. A method for manipulating a pre-dosed container along a working line, wherein said method comprises the following steps:

removing a cover and/or lid from a pre-dosed container of a fluid product at a first manipulation station;

conveying said cover and/or lid by a movement system comprising two or more conveyance systems adapted to overturn said cover and/or lid;

moving said container towards a working station;

at said working station, executing an operation on said fluid product contained in the container;

moving said container towards a second manipulation station;

at said second manipulation station, fixing said cover and/or lid onto the container after recovering said cover and/or lid from said movement system.

* * * * *